United States Patent [19]

Cossairt

[11] Patent Number: 5,074,759

[45] Date of Patent: Dec. 24, 1991

[54] FLUID DYNAMIC PUMP

[76] Inventor: Keith R. Cossairt, 150 Oak Ridge Pl., Apartment 7B, Greenville, S.C. 29615

[21] Appl. No.: 493,295

[22] Filed: Mar. 14, 1990

[51] Int. Cl.[5] ..... F04F 5/44

[52] U.S. Cl. ..... 417/198; 417/163; 417/171; 417/183; 417/197

[58] Field of Search ..... 417/163, 170, 151, 182, 417/183, 197, 171, 198; 137/888, 896

[56] References Cited

U.S. PATENT DOCUMENTS

| | | | |
|---|---|---|---|
| 2,293,115 | 8/1942 | Child | 417/171 |
| 2,444,615 | 7/1948 | Reinhardt | 417/170 |
| 4,046,492 | 9/1977 | Inglis | 417/197 |
| 4,192,461 | 3/1980 | Arborg | 417/197 |
| 4,815,942 | 3/1989 | Alperin et al. | 417/170 |

*Primary Examiner*—Richard A. Bertsch
*Assistant Examiner*—Michael I. Kocharov
*Attorney, Agent, or Firm*—Bailey & Hardaway

[57] ABSTRACT

This invention relates generally to pumps, and more particularly, to a new concept in pumps where the principle of operation is based on the change in momentum of a curved, fluid jet curtain, with the pump itself containing no moving parts.

3 Claims, 7 Drawing Sheets

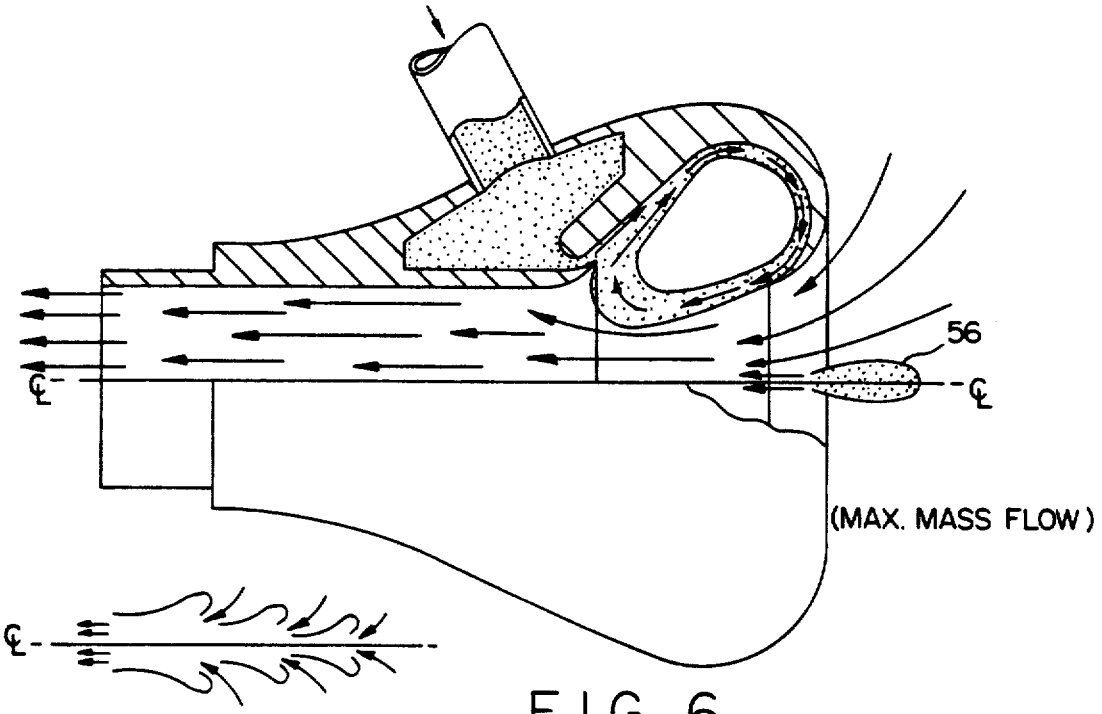
FIG. 6
FIG. 6A
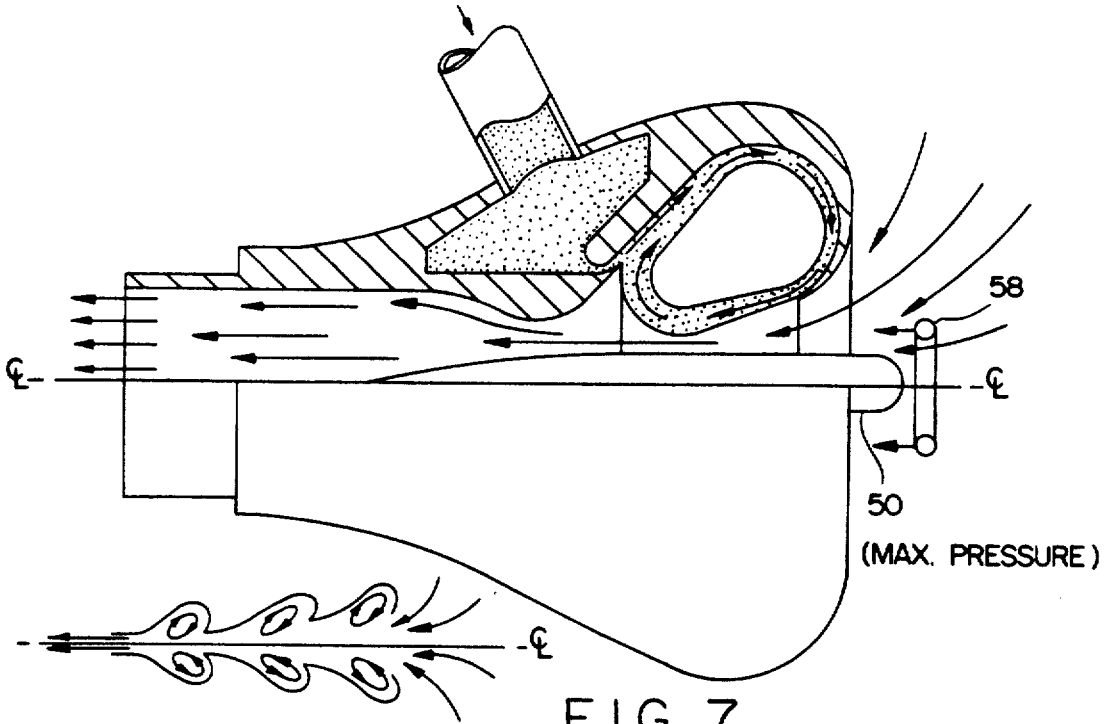
FIG. 7
FIG. 7A

FLUID DYNAMIC PUMP

BACKGROUND OF THE INVENTION

This invention generally relates to pumps, and more particularly, to a new concept in pumps where the principle of operation is based upon the change in momentum of a fluid jet curtain.

Inasmuch as this invention encompasses a broad range of art, reference is made to six (6) specific fields in order to review some prior-art areas where this invention has impact:

a. Fans and blowers; Characterized by high volume flow at low static pressures.

Fans and blowers typically contain a rotating member which imparts velocity (momentum) to a media. The media must be relatively clean or this rotating member will become damaged or out of balance. The range of operation is limited and the media is essentially limited to atmospheric air.

b. Centrifugal Pumps; Characterized by high static pressures and relatively low flow rates.

Centrifugal pumps typically contain a rotating member which imparts velocity (momentum) to the media via the action of a centrifugal force. The media must be relatively clean or the rotating member will become clogged or damaged. The range of operation is limited, although hybrid and/or compound devices (mixed flow) can increase the operating range for a significant cost.

c. Suction Pumps; Characterized by moderate flow rates and low static pressures at the pump inlet (negative gage pressure).

Suction pumps typically contain an enclosed rotating member which is designed to ingest moderate amounts of foreign matter. Suction pumps are designed to be disassembled and the worn parts replaced and/or rebuilt periodically. This constitutes an added cost to the operation of this unit.

d. Ejectors; Characterized by a high pressure source of primary fluid for power and a specially designed shroud.

Ejectors are inexpensive, durable, maintenance free and lightweight. Ejectors, however, have a small operating range, are the least efficient of all pumps, and are very sensitive to back pressure (static head that it can pump against). Additionally, since ejectors depend on viscous entrainment and turbulent mixing to accomplish the momentum exchange between the primary driving fluid and the secondary media, the amount and type of foreign matter ingested is very important.

e. Jet Propulsion; Characterized by devices such as ram jets, pulse jets and under-water jets (specifically excluding axial flow, multi-stage gas turbines as exemplified in modern jet aircraft).

Jet propulsion devices, as listed herein, have received considerable attention primarily because of their inherent simplicity. However, in spite of the considerable research and development efforts made with regard to these concepts, significant room for improvement exists.

Consider first the ram jet: Ram jets exhibit deficiencies in their ability to develop static thrust and consume excessive quantities of fuel. Limited use of the ram jet has occurred in very specialized military applications.

Consider next the pulse jet: While the pulse jet is capable of generating static thrust, the low efficiency, short lived valves (reeds) and extremely high noise levels has prevented any known use. This is the jet engine of the notorious V1 Buzz Bomb of World War II.

Finally, consider other devices such as the an underwater jet propulsion engine which uses compressed air through a porous wall to simulate combustion; thereby expelling the water through an exhaust nozzle and generating thrust. This engine has the same deficiencies as the ramjet, with regard to static thrust and efficiency plus other negative characteristics.

f. Combustion Burners; Such devices are of a very mature engineering design, being the recipient of over 100 years of design, development and use. In spite of this fact, no know effort has been successful in increasing the pressure ratio of combustion (increasing the static pressure of combustion).

While many areas of application of this invention have been reviewed above, it is apparent that a need exists within the prior art for improvement.

SUMMARY OF THE INVENTION

It is thus an object of this invention to provide a novel method and apparatus for pumping fluids.

It is a further and more particular objects of this invention to provide such a novel method and apparatus which is applicable to a wide field of endeavor.

It is thus a further and yet more particular object of this invention to provide a novel pumping method and apparatus which has application to fans and blowers, centrifugal pumps, suction pumps, ejectors, jet propulsions, combustion burners, robotics, fluidics and other fields of endeavor.

These, as well as other objects, are accomplished by conduit means having an entrance and an exit, a first annular opening defined within the conduit means for exhausting a fluid media, and a second annular opening about the conduit means for intaking fluid media. The process is carried out by expelling a fluid medium from the exhaust annular opening, and intaking fluid media into the intaking annular opening thereby causing fluid media to be pumped from the conduit entrance to the conduit exit as a result of a change in momentum of the fluid media transported from the exhaust annular opening to the intake annular opening.

BRIEF DESCRIPTION OF THE DRAWINGS

FIG. 6 is a view similar to FIG. 1 illustrating an embodiment obtaining maximum mass flow rate.

FIG. 6A is a schematic illustration of an embodiment having multiple staging.

FIG. 7 is a view similar to FIG. 1 illustrating an embodiment suitable for obtaining maximum pressure.

FIG. 7A is a schematic illustration of an embodiment optimized to obtain high discharge static pressure by multiple staging of the apparatus.

DETAILED DESCRIPTION

Figure 1:
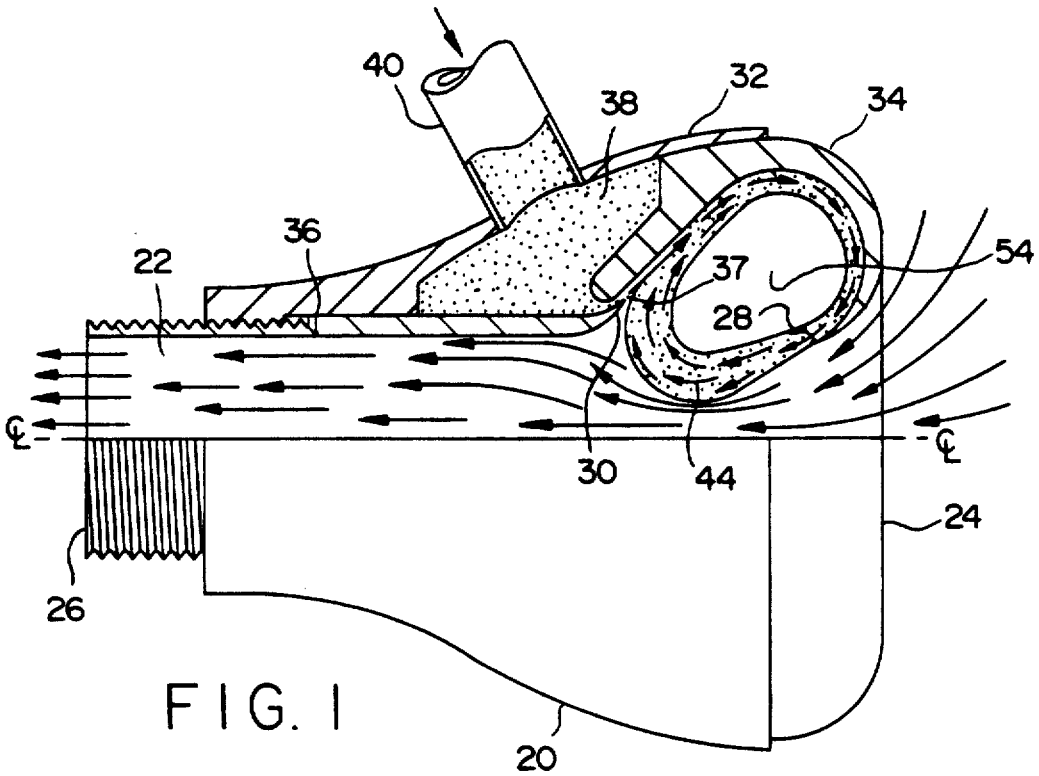
FIG. 1 of the drawings is a partial cutaway view of an apparatus in accordance with this invention.

This invention, in its purest form, creates and sustains a static pressure gradient between two stations in a closed system. The consequence of this is the ability to do work on a fluid by causing it to move (to accelerate a mass in motion), or to compress a static media (increase the static pressure of a fluid at rest). This results in a multitude of potential uses such as: transporting fluids (in conduits); ejecting fluids at a high velocity to create thrust (with or without combustion); compressing the products of combustion thereby increasing the efficiency of combustion and yielding more heat energy; and generating unique features such as a constant force-vs-position device which has applications in the field of Robotics and as a pneumatic/hydraulic "rectifier" or "gate", which has application in the field of Fluidics.

While this invention may be described herein at different times in terms of aerodynamics and at other times in terms of hydraulics, it should be understood that as herein disclosed, it is equally applicable to all fluids (liquids and gases or mixtures of liquids, gases, various selected solid particles and "fluidized" solids). Further, this invention has virtually no physical size restrictions and even through subsonic velocities are assumed in the preferred embodiment, this invention may also be used where supersonic velocities are encountered.

Accordingly, several objects and advantages of this invention are:

a. Fans and Blowers—This invention, designed specifically for optimum performance in the media and over the operating range of fans and blowers, will operate over a much broader range, is very light weight, and contains no moving parts to wear out or to become damaged or out of balance. It can operate in extreme conditions of temperature, humidity, contamination, mechanical shock, and vibration; and with no moving parts it is safe to use anywhere, especially in hazardous areas and volatile atmospheres.

b. Centrifugal Pumps—This invention, designed specifically for optimum performance in the media and over the operating range of centrifugal pumps, will operate over a much broader range, is very light weight and contains no moving parts to wear out or to become damaged or out of balance. It can operate in extreme conditions of temperature, humidity, contamination, mechanical shock, and vibration; and with no moving parts it is safe to use anywhere, especially in hazardous areas and volatile atmospheres.

c. Suction pumps—Being fundamental to the operation of a suction pump, this invention will be able to ingest large quantities of foreign matter, whether the matter be oil floating on the open sea, debris from the streets of a city, or dredged sand and gravel from the bottom of navigable waterways. The embodiment of this invention as a suction pump will result in a pump of superior performance and lower cost than any known suction pump. Furthermore, it will operate over a wide range of operating conditions and has no moving parts to wear out.

d. Ejectors—The invention provides for optimum performance in the media and over the operating range of an ejector, and operates over a much broader range, is more efficient and will pump against a much larger static head than any known ejector. Additionally, the apparatus of this invention is smaller in size and is relatively insensitive to the size and character of the foreign matter ingested.

The prior art of ejectors teach that in order for an ejector to function, the primary flow must interact with the secondary flow through viscous entrainment and turbulent mixing, followed by an expansion of the tertiary flow and subsequent exhaust at the design static pressure. The principle of operation of the invention is quite different from that of an ejector. So much so that it makes no difference if the media is viscous or not, in order to pump against a static head. This difference is further apparent in the comparison of the magnitude of static pressures which the ejector and this invention can pump against. Theory and test data indicate that for comparable devices, this invention will pump against a total head which is an order of magnitude higher than that possible with an ejector.

e. Jet Propulsion—The embodiment of the invention results in an engine unlike any other known jet engine. As a "cold" jet engine (without combustion) it has the capability of developing static thrust and a propulsive force while emersed in either air or water. With combustion, the operating range and overall performance in both of these media is considerably extended. Having no moving parts, being extremely durable and reliable, inexpensive and light weight, this device has no known counterpart.

f. Combustion Burners—The embodiment of this invention in the form of a combustion burner results in a burner unlike any other known burner. In this embodiment combustion occurs at a static pressure greater than ambient, thereby increasing the efficiency of combustion and the heat released, thereof.

g. Robotics—This invention contains a unique characteristic in that it is able to generate a constant force, which has application in robotics. No known single device is able to accomplish this without the use of a multiplicity of devices such as pressure sensing/relief valves, accumulators and switches.

h. Fluidics—This invention also contains an additional unique characteristic in that it restricts the flow of a fluid in one direction while allowing free passage or amplifying the flow in the other direction. This is sometimes referred to as a rectifier or gate.

Various other advantages and features will become apparent from the following description given with reference to the various figures and drawings.

Figure 2:
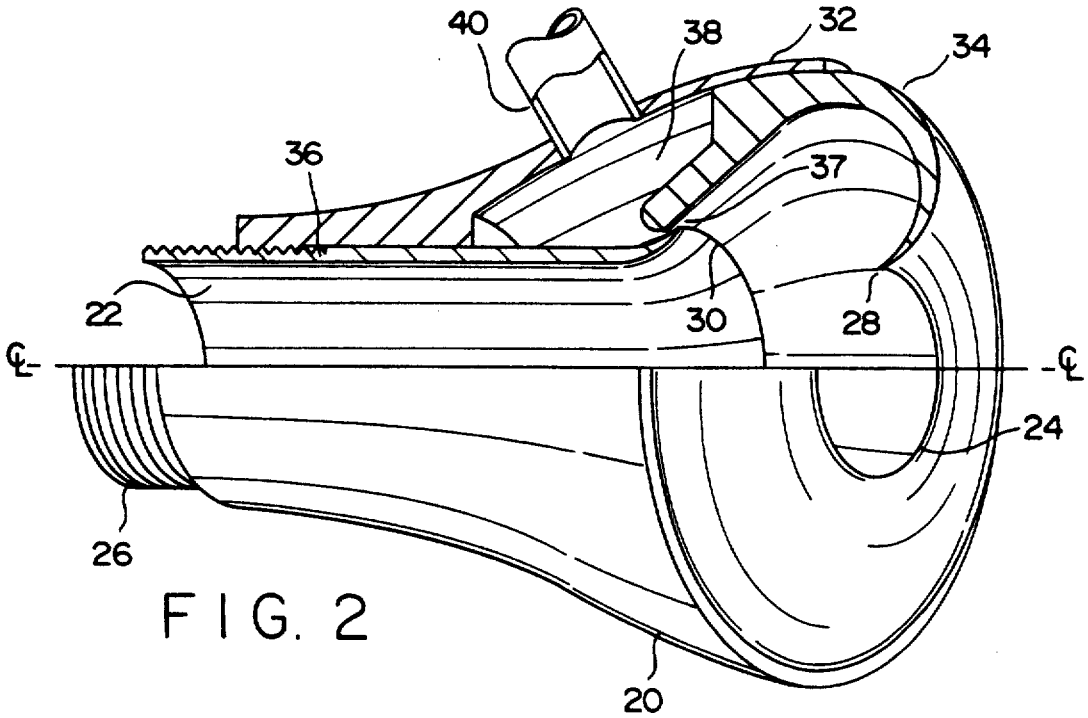
FIG. 2 is a perspective partial cutaway view of the apparatus illustrated in FIG. 1.
Figure 3A:
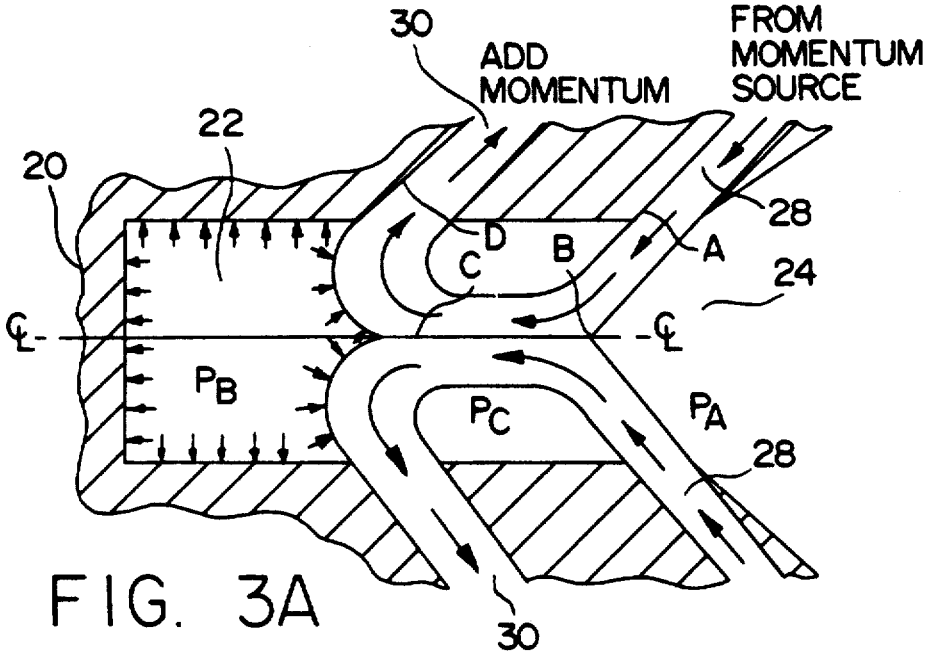
FIGS. 3A and 3B are schematic illustrations showing flow parameters in accordance with this invention.
Figure 3B:
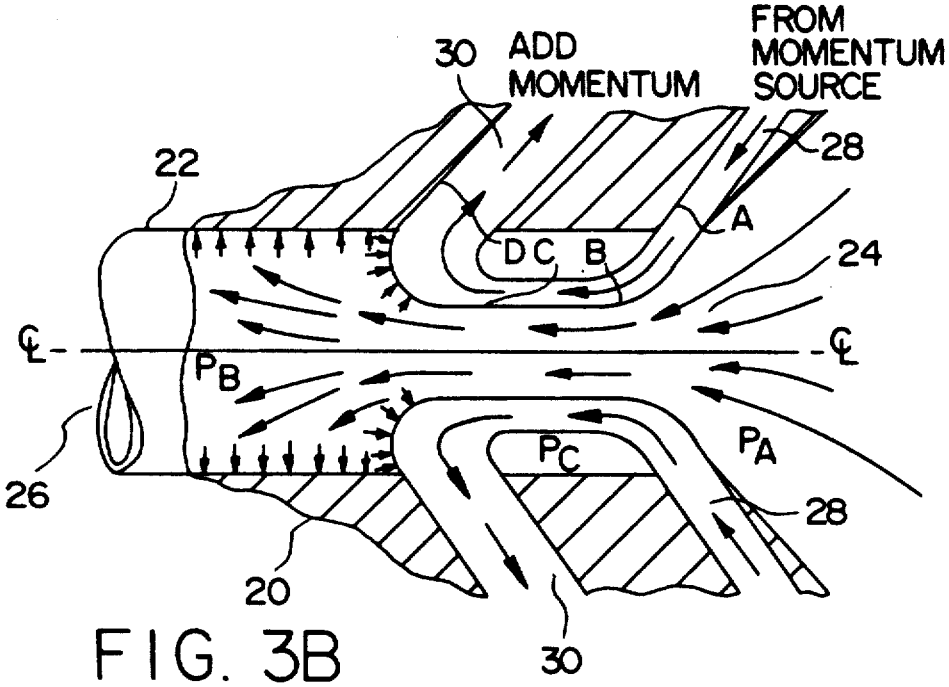

FIGS. 1 and 2 of the drawings illustrate a preferred embodiment of the apparatus and the process carried out by this invention. FIGS. 3A and 3B schematically illustrate the invention in its simplest form. The apparatus 20 comprises means defining a conduit 22 having an entrance end 24 and an exit end 26. Conduit means 22 has two annular openings defined and communicating with the interior of the conduit means for controlling flow of fluid media therethrough. A first annular opening 28 permits introduction of a fluid media into the interior of the conduit means 22. A second annular opening 30 which is disposed from the first annular opening 28 toward the exit end 26 of conduit means 22 is for the intake of fluid media. The operation of the fluid media will be further described below.

FIG. 1 and 2 illustrate an apparatus in accordance with this invention. The apparatus comprises a hollow bell-like assembly comprising of four parts defining the conduit means 22 and its associated annular rings. An outer shell 32 encompassing most of the entire apparatus is attached to an inner shell 34 on one end. An adjustable throat 36 is provided by way of a threaded fitting on the opposite end. The primary power fluid is constrained in a cavity (plenum) 38 between the outer shell 32, the inner shell 34 and the throat 36. An inlet supply tube 40 communicates with the plenum 38. The attachment between outer shell 32 and inner shell 34 must be with a permanent pressure tight bond or a sealed, leak proof fitting. Likewise, the same is true for the fitting between outer shell 32 and adjustable throat 36. Except for the supply tube 40, the apparatus is axially symmetrical about the longitudinal centerline.

By rotating the adjustable throat 36 with respect to outer shell 32, the annular opening 37 (primary exhaust orifice) between adjustable throat 36 and inner shell 34 is adjusted. The desired adjustment depends on the media, design considerations and operational factors. In some embodiments this adjustment may be fixed instead of variable. Under this condition, it is possible to construct this embodiment of only one integral part, instead of the four parts referenced.

An added feature such as a locking nut may be threaded on adjustable throat 36 and tightened against the aft end of the said outer shell 32 thereby preventing any accidental movement. This assures that the final adjustment of the throat remains fixed during operation. Other design features such as an inlet grill/screen, rub and chaff guards, the material of construction, and the size and weight may be determined by engineering analysis by one skilled in the art.

Having generally described the apparatus of this invention, the method and parameter of operation will now be described.

FIGS. 3A and 3B are simplified schematic illustrations jointly showing two extremes of operation—no flow FIG. 3A and full flow FIG. 3B. Considering first FIG. 3A, the fluid media is exhausted from an annular port 28 at station A at an inward angle such that the jet curtain joins together at station B. The flow pattern between A and B is similar to a fluid flowing over the outside of a cone, flowing from a base A to the apex B. Though this invention can perform in a two dimensional configuration, the preferred embodiment is of a three dimensional configuration. Accordingly, visualize the configuration shown in FIG. 3A and FIG. 3B as being axially symmetrical about the shown centerline. The flow continues on to station C in the form of a cylindrical jet. It is not essential that stations B and C be separated by any given distance. In some embodiments or operating conditions this distance (B to C) may be equal to zero. However, it is important for best efficiency that the fluid curtain reach station C as a uniform, symmetrically shaped jet. At station C the jet parts and forms a shape similar to the conical shape between A and B, except that the jet curtain is curved. The jet curtain subsequently enters the annular port 30 at station D. The reason the jet curtain is curved is because of the static pressure ($P_B$). The reason for this static pressure comes from the laws of physics. To paraphrase this law for this specific application the pressure-force must be equal and opposite to the change in momentum of the jet, or, the change in momentum of the jet curtain (between stations C and D) must be equal to the pressure gradient across this curved jet curtain multiplied by the cross sectional area; therefore, $$\frac{m\overline{V}}{g}(1 + \cos\Theta_i) = (P_B - P_C)\pi(r_i)^2,$$

For a close approximation, this equation reduces to $$P_B = \frac{\overline{(r)}}{r_o} \quad \frac{\delta(V_o + V_i)^2}{2g}(1 + \cos\Theta_i)$$

If it is desired that $P_c$ will always be equal to zero, this may be accomplished by segmenting the annular exhaust jet at station A. This provides a vent between the inner and outer surfaces of the exiting jet curtain and assures that the static pressure will be the same on both sides. The jet curtain will coalesce and by the time it reaches station C it will function as if there were no segmentation.

Energy, in the form of momentum must be added to the jet curtain between stations D and A. This may occur in many different forms, as one skilled in the art may choose their own preference. Several different methods will subsequently be described.

Referring to FIG. 3B, the flow dynamics are exactly the same as we described for FIG. 3A, with the exception that outside ambient fluid is being ingested by the reduced inlet pressure and by viscous entrainment. Dependent variables such as the amount of ambient fluid being ingested (i.e., the mass augmentation ratio) cannot be estimated precisely by analytical methods. However, empirical results, along with good design practice and built-in adjustment features in a prototype model will provide an optimized configuration for a given application.

The preferred embodiment of this invention is shown in FIGS. 1 and 2 and can be described as an ejector powered recirculating oblate toroidal jet momentum pump. Each term of this description has meaning and will be explained in the following. With reference to FIG. 1, the preferred embodiment is shown for a general purpose air/water pump. The choice of the words "air/water pump" mean precisely that—the exact same physical pump can pump a gas such as air or pump a liquid such as water. This is a unique innovation in pump design, not known to exist in any other pump. The only modification required is an adjustment to the opening 37, in FIG. 1. Additionally, if the ambient fluid is a liquid such as water, it is not mandatory that the primary driving fluid also be of the same liquid. The primary driving fluid may be another liquid or even a gas, such as air.

As shown in FIG. 1, the primary driving fluid enters through the inlet supply tube 40 to a plenum chamber 38. This plenum chamber is sized and shaped for particular applications. In some designs it may take the form of a donut shaped header. The essential design requirement here is to efficiently conduct the primary driving fluid from its source to the primary exhaust orifice 37. The internal cross sectional area, as viewed from the source of the primary power to the plenum must be greater than the annular throat area or there will be choking of the primary fluid upstream of the throat (for pressures greater than the critical pressure ratio of the primary fluid). Losses such as those due to inlet design, velocity head, turbulence, heat, viscosity and exit design all need to be considered for particular applications. The primary driving fluid is discharged from primary exhaust orifice and by way of viscous entrainment and turbulent mixing, momentum is added to the recirculating flow 44. In continuous steady state operational conditions, this added momentum replenishes the expended energy in the recirculating curtain. This recirculating curtain normally contains more energy than the primary driving fluid which is only required to make up the deficit due to friction, turbulence, heat and other such losses.

Two questions require explanation at this juncture. One, there appears to be only one half of a conventional ejector shown in FIG. 1. Two, the recirculation flow field appears deceptively like a vortex. First, it has been surprisingly found through experimentation that for recirculating flow, an inner wall, which would be placed where a phantom void 54 is illustrated and would form the missing side of a conventional annular ejector is not necessary. In some situations, it has been found that an inner wall improved the overall performance. However, the added complexity, cost and the possibility of clogging the recirculating flow inlet were offset by the simplicity and reliability shown in the preferred embodiment. Secondly, the recirculating flow field does possess a limited amount of similarity to free vortex flow, it does so only between stations C and D shown in FIGS. 3A and 3B. Except for the suction embodiment shown in FIG. 9, nowhere else in the path of the recirculating flow is there any other similarity to vortex flow. This is imperative in understanding the mechanics involved in the operation of this invention.

With this understanding, the analysis of the flow field and the preliminary performance estimates may be derived from the teachings set forth in this disclosure.

In summary, the recirculating flow field of the preferred embodiment of this invention is in the shape of a distorted torus, having the unique characteristics previously described between stations A, B, C and D. The preferred embodiment, therefore, consists of the following characteristics;

a. ejector powered,
b. recirculating flow field,
c. oblate toroidal in shape,
d. curved jet of liquid or gas, which experiences a momentum change.

Figure 4:
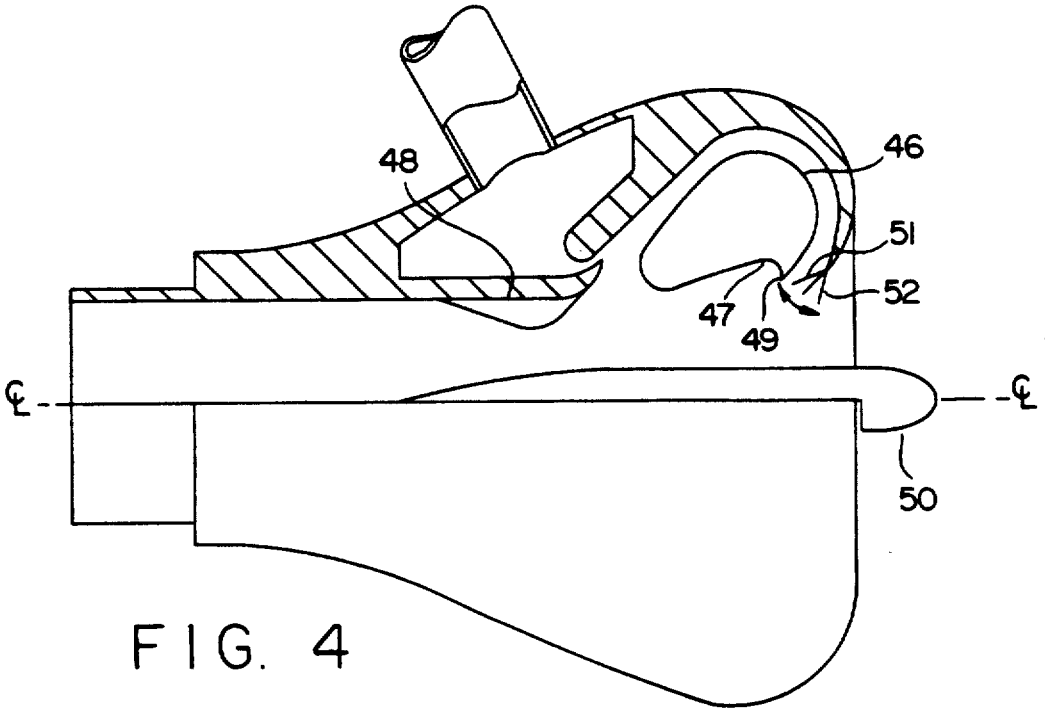
FIG. 4 is a view similar to FIG. 1 illustrating an embodiment of this invention.

FIG. 4 shows an additional embodiment. The apparatus shown in FIG. 4 is identical to the apparatus shown in FIGS. 1 and 2 except that it is constructed of a single piece and contains additional parts 46, 47 48, 49, 50, 51 and 52. It is apparent in FIG. 4 that there is no adjustable throat 36 as was shown in FIGS. 1 and 2. A toroidal center-body 46 is included in this embodiment and forms the inner wall of the ejector and helps direct the recirculating flow around the turn and to the annular exhaust. The purpose of center-body 46 is to improve the efficiency by improving the turbulent mixing process of the ejector and to minimize the internal turning losses. The underside of the center-body 46 is undercut at 47, containing a sharp lip 49 at the exit of the annular opening 28. In some configurations this has been found to be necessary in order to prevent the flow form attaching to the bottom of the center-body—this is called the Coanda effect. When this occurs, it totally disrupts the operation of the invention, however this will not occur with a properly designed center-body. An annular inlet plug 48 is included in this embodiment and is shaped and positioned so as to cause the radius of curvature of the recirculating flow to be decreased, thereby increasing the apparatus discharge static pressure.

It should be understood that the static pressure, or head that the pump will pump against is inversely proportional to the turning radius of the curved jet—all else being equal. A similar result to that of the inlet plug 48 occurs by the use of a centerline plug 50, which also reduces the value of the turning radius of the recirculating jet. The centerline plug 50 may have various sizes and shapes and be adjustable along the longitudinal centerline of the invention. The effect of centerline plug 50 is to cause the pump discharge pressure and flow rate to vary without changing any other of the independent variables (such as the pressure/flow rate of the primary driving fluid.) Exit flaps 52 may be installed to redirect the angle of the exhausting jet flow in order to influence the performance of the invention. The center body 46, inlet plug 48 and centerline plug 50 may be incorporated separately or jointly with the basic apparatus of this invention and may be adjustable or detachable.

Figure 5:
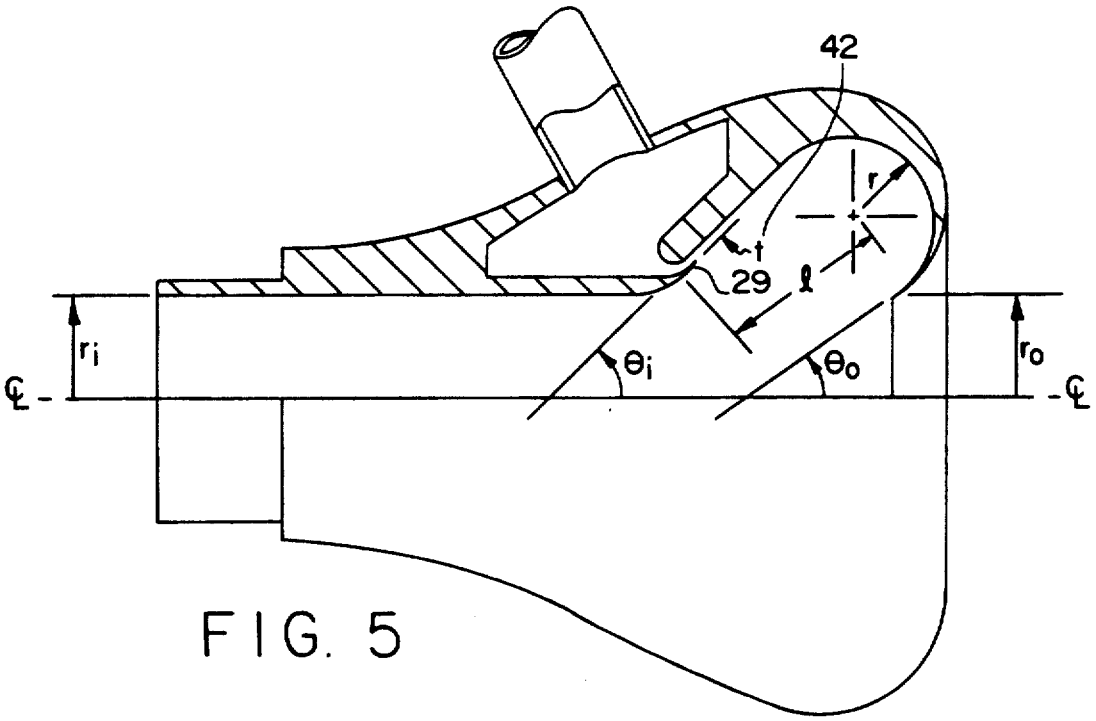
FIG. 5 is a view similar to FIG. 1 identifying physical variables which variables are discussed within the specification.

The physical variables effecting the operation and performance are shown in FIG. 5. The significance of these variables—independent variables—is further shown in Table I. The combination of FIG. 5 and Table I is herein used to expand on the relationship of these variables as they relate to various applications. Referring to FIG. 5 and Table I, the dimensions of these variables are given for the general purpose pump and by comparison, the relationship of these variables is shown for the other embodiments. These dimensions may be scaled up or down as the application may require and other embodiments may have a completely different set of dimensions.

TABLE I

| | | INDEPENDENT VARIABLES | | | | | | |
|---|---|---|---|---|---|---|---|---|
| FIG. | CONFIGURATION | $\Theta_o$ | $\Theta_i$ | $r$ | $r_i$ | $r_o$ | $t$ | $l$ |
| 1-2 | GENERAL PURPOSE | 30 | 45 | 0.75 | 1 | 0.9 | 0.1 | 1.5 |
| 6 | MASS FLOW (M) | LESS | MORE | MORE | MORE | MORE | EQUAL | EQUAL |
| 7 | PRESSURE (P) | EQUAL | LESS | EQUAL | LESS | LESS | EQUAL | EQUAL |
| 8 | THRUST (T) | EQUAL | LESS | EQUAL | LESS | EQUAL | LESS | EQUAL |
| 9 | SUCTION (S) | LESS | EQUAL | EQUAL | EQUAL | EQUAL | EQUAL | LESS |
| 10 | HEAT (Q) | EQUAL | LESS | EQUAL | LESS | LESS | EQUAL | EQUAL |
| 11 | ROBOTICS | EQUAL | LESS | EQUAL | LESS | LESS | EQUAL | EQUAL |

TABLE I-continued

| FIG. | CONFIGURATION | INDEPENDENT VARIABLES $\Theta_o$ | $\Theta_i$ | r | $r_i$ | $r_o$ | t | l |
|---|---|---|---|---|---|---|---|---|
| 12 | FLUIDICS | EQUAL | EQUAL | M. LESS | M. LESS | M. LESS | M. LESS | M. LESS |

NOTES:
1. Dimensions of $\Theta_o$ and $\Theta_i$ are in degrees.
2. Dimensions of r, $r_i$, $r_o$, t and l are in inches.
3. t is determined by the primary driving fluid used and the total pressure.

Tables I and II are organized to show a comparison of the relative design variables and consequential performance characteristics for other apparatuses which have been designed with emphasis on specific performance parameters. These parameters shown in Table II are referred to as dependent variables and each apparatus (which has been optimized for a specific performance characteristic) is compared to the general purpose apparatus.

TABLE II

| FIG. | RAMIFICATION | DEPENDENT VARIABLES M | P | T | S | Q |
|---|---|---|---|---|---|---|
| 1-2 | GENERAL PURPOSE | MED | MED | MED | MED | MED |
| 6 | MASS FLOW (M) | HIGH | LOW | LOW | LOW | LOW |
| 7 | PRESSURE (P) | LOW | HIGH | MED | LOW | LOW |
| 8 | THRUST (T) | HIGH | HIGH | HIGH | MED | HIGH |
| 9 | SUCTION (S) | MED | MED | LOW | HIGH | NA |
| 10 | HEAT (Q) | HIGH | LOW | LOW | LOW | HIGH |
| 11 | ROBOTICS | LOW | MED | VARIES | LOW | NA |
| 12 | FLUIDICS | V. LOW | MED | LOW | MED | NA |

TABLE III

| SYMBOLS & ABBREVIATIONS | |
|---|---|
| $\Theta_o$ | Angle of discharge of recirculating jet at station A, ref. longitudinal centerline, degrees |
| $\Theta_i$ | Angle of intake of recirculating jet at station D, ref. longitudinal centerline, degrees |
| $\pi$ | Pi |
| $\delta$ | Density of the media, lb/cubic ft |
| l | Length of mixing section of recirculating ejector, inches |
| m | Mass flow of recirculating jet between stations C and D, lbs/sec |
| r | Turning radius of recirculating ejector jet, inches |
| $r_i$ | Radius of opening of apparatus at the entrance end, inches |
| $r_o$ | Radius of opening of apparatus at the exit end, inches |
| $\bar{r}$ | Average turning radius of curved jet between stations C & D, inches |
| t | Adjustable throat of apparatus, inches |
| $\bar{t}$ | Average thickness of curved jet between stations C & D, inches |
| M | Apparatus optimized for maximum MASS FLOW |
| P | Apparatus optimized for maximum PRESSURE |
| $P_a$ | Ambient pressure, lb/sq in |
| $P_b$ | Discharge static pressure, lb/sq in |
| $P_c$ | Cavity pressure sensed by the inside streamlines of the curved jet between stations C & D |
| Q | Apparatus optimized for maximum HEAT TRANSFER |
| S | Apparatus optimized for maximum SUCTION |
| Y | Apparatus optimized for maximum THRUST |
| $\bar{V}$ | Average velocity of curved jet between stations C & D, ft/sec |
| $V_i$ | Velocity of media at Station A, ft/sec |
| $V_o$ | Velocity of media at Station D, ft/sec |

For optimum mass flow (M), refer to FIG. 6. If the objective is to induce the maximum possible throughflow, then this invention has application in such areas as: ventilation, cooling, heating, drying, and dehumidifying, and with the injector nozzle 56, further applications include spraying fluids such as insecticides, fertilizer, paints, protective coatings, cleaning solutions, blowing foam for insulation and artificial snow.

FIG. 6A is a schematic illustration showing how multiple stages of the concept may be arranged to obtain even higher mass flow through the apparatus.

For optimum static pressure (P) increase, refer to FIG. 7. If the objective is to increase the static pressure of the tertiary flow as much as possible, then the invention has application in such areas as: well/sump pump; pipeline booster pump; dewatering at construction sites; pumping fluidized solids; conveying grain; aeration-/agitation and blending of slurries, liquids and gases; pumping sewage; conveying sawdust, chips, cement, pulverized coal and ash; as an agriculture pump, trash pump; pumping underground fluids to the surface such as oil, water and sulfur and with the injection nozzle as a sand blasting device.

FIG. 7A is a schematic illustration showing how multiple stages of concept may be arranged to obtain even higher static pressures.

Figure 8:
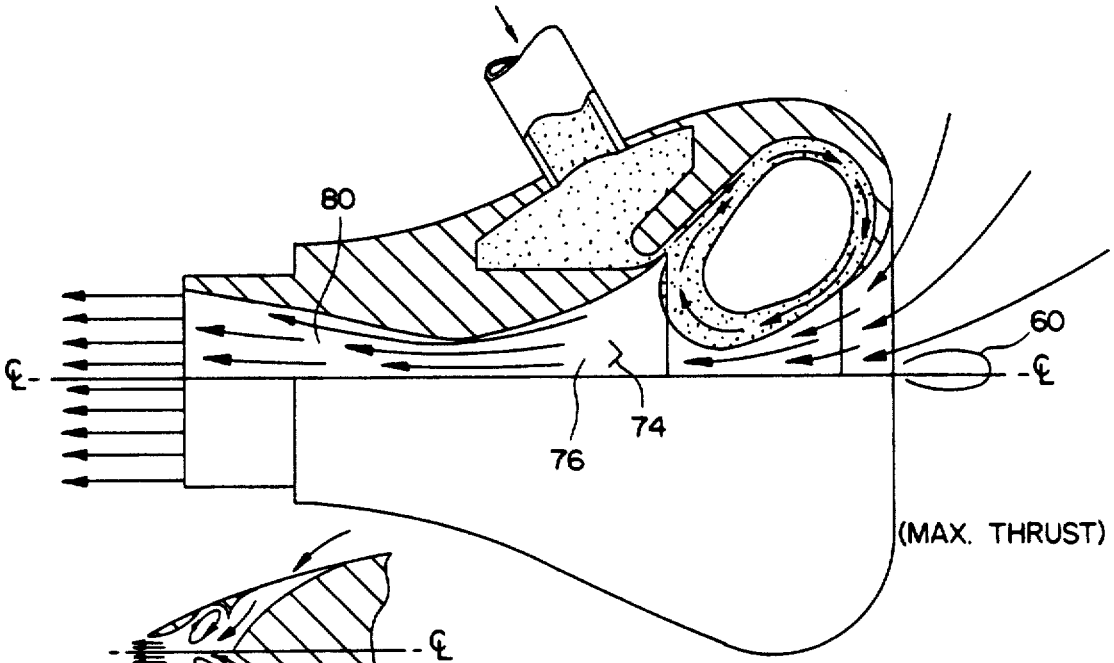
FIG. 8 is a view similar to FIG. 1 illustrating an embodiment for obtaining maximum thrust.

For optimum thrust (T), refer to FIG. 8. If the objective is to maximize the momentum imparted to the tertiary flow, the invention has application in such areas as: jet propulsion engine for operation in the air (atmosphere) or underwater, (either with or without internal combustion) as marine maneuvering side thrusters, tip jets to power the rotor of a helicopter and first stage boosters for rockets and missiles. The apparatus, as shown in FIG. 8, indicates that the critical pressure ratio of the media has been exceeded and the exhausting gas is traveling at a speed greater than sonic velocity from the supersonic nozzle 80. Fuel is introduced through an injector nozzle 60 and flame holders 74 are located in the combustion chamber 76. Various type of fuels may be used, with or without an oxidizer, including liquid monopropellants.

Figure 8A:
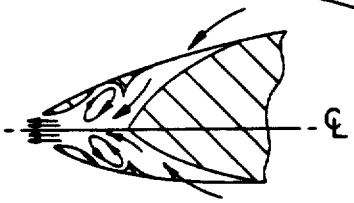
FIG. 8A is a schematic illustration of an embodiment integrated into a missile or rocket to provide propulsive thrust.

FIG. 8A illustrates schematically how the invention may be integrated into the body of missile which may be operated in the atmosphere or under water. Other embodiments may include "strap on" configurations for such as first stage boosters.

Figure 9:
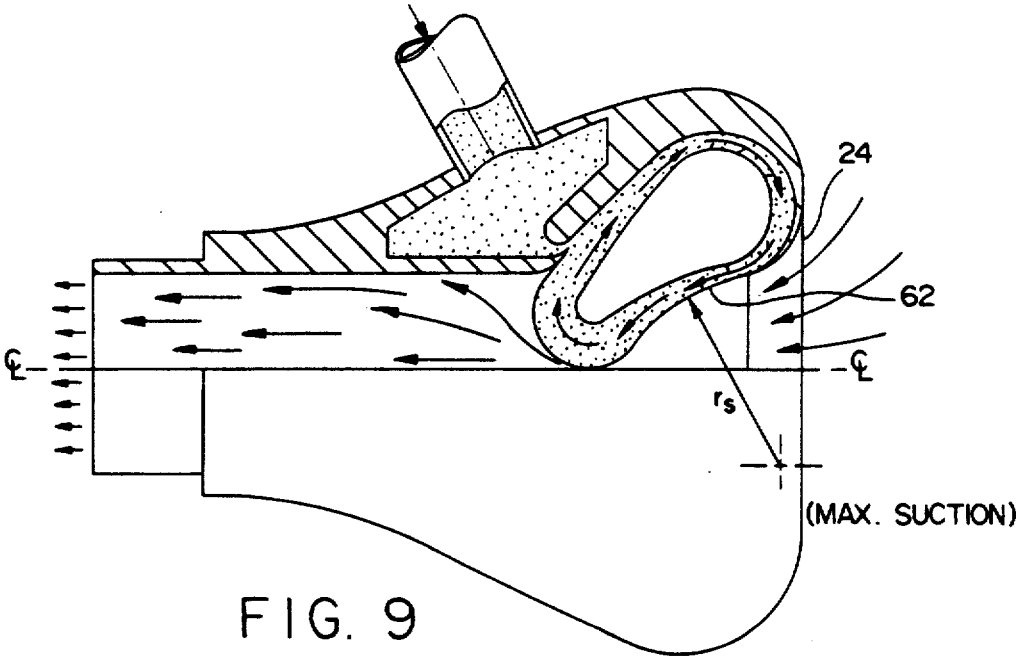
FIG. 9 is a view similar to FIG. 1 illustrating an embodiment suitable for obtaining maximum suction at the inlet of the apparatus.

For optimum suction (S), refer to FIG. 9. If the objective is to obtain the lowest (negative) static pressure at the inlet of the device, then the invention has application in such areas as: the suction head for cleaning an oil spill, dredging from the sea floor, sea harvesting, snow removal, street/plant floor vacuum, harvesting grove-/orchard produce, aquaculture (esp. conveying live creatures), brush fire fighting by inundating the brush with dirt/soil, and for exhaust gas scavenging for internal combustion engines.

Notice in FIG. 9 that the curvature of the recirculating jet Near the apparatus entrance 24 has negative curvature 62. Even though the total pressure gradient between the entrance and exit of this configuration is approximately the same as that for the general purpose configuration, the apparatus of FIG. 9 is capable of generating relatively high values of suction at the entrance. This is a result of the aforementioned negative curvature of the jet.

Figure 10:
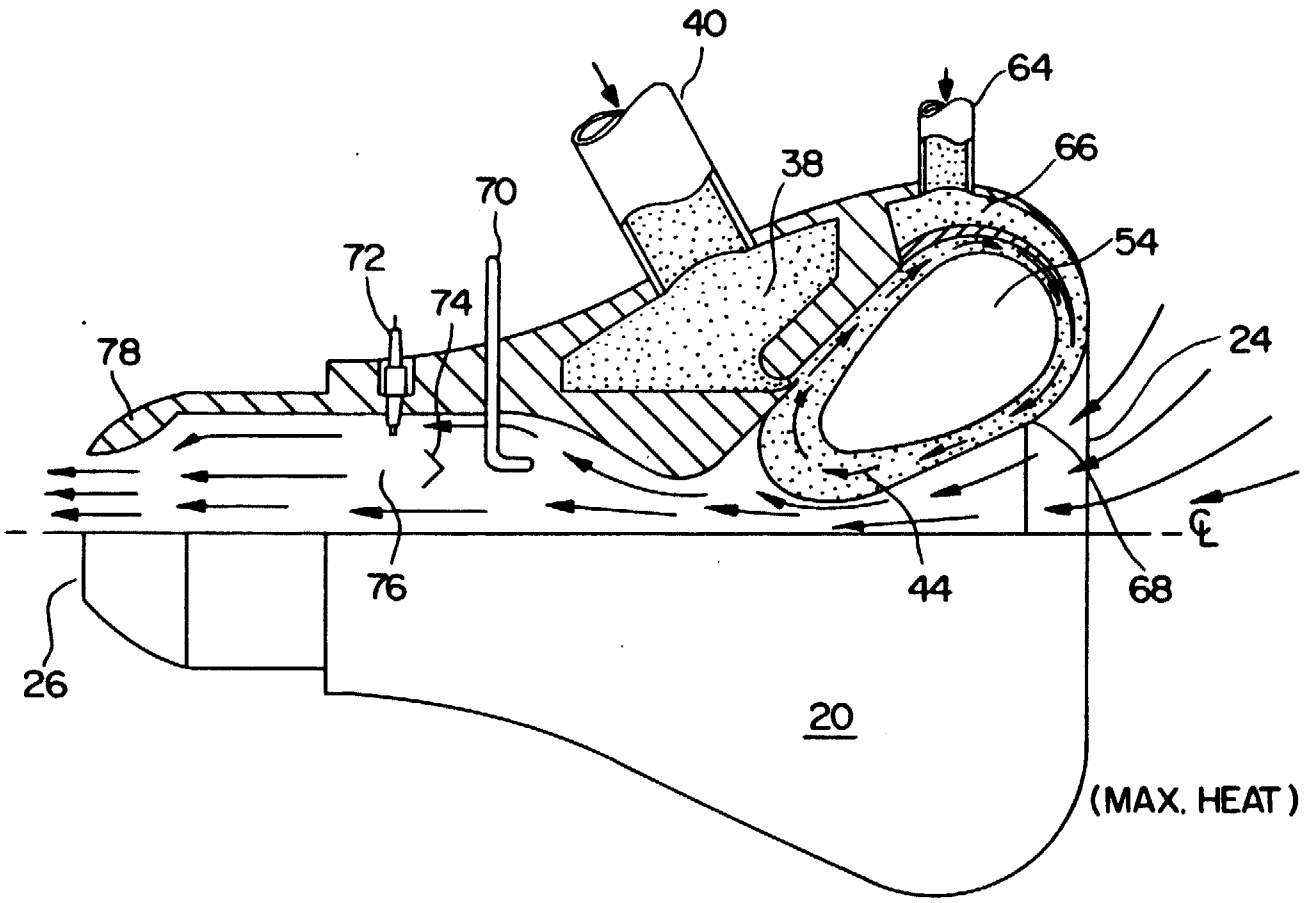
FIG. 10 is a view similar to FIG. 1 illustrating an embodiment suitable for obtaining maximum heat of the discharged media at the exit of the apparatus.

For optimum heat transfer (Q), refer to FIG. 10. If the objective is to optimize heat obtainable (as measured in BTU/hr), then the invention has application in such areas as: a furnace or boiler burner, grove and orchard heater and fog dispersal at airports.

This apparatus, which is shown in FIG. 10, has several features which can also be incorporated in previous apparatuses referred to above. These features are:

a. A secondary stage, as shown by the secondary supply tube 64, secondary plenum 66 and secondary annular opening 68. This secondary stage may contain the same media as the primary, or it may consist of a gaseous fuel;
b. Fuel injectors 70;
c. Combustion chamber 76;
d. Flame holders 74;
e. Igniter, spark plug or glow plug 72; and
f. Nozzle 78.

Figure 11:
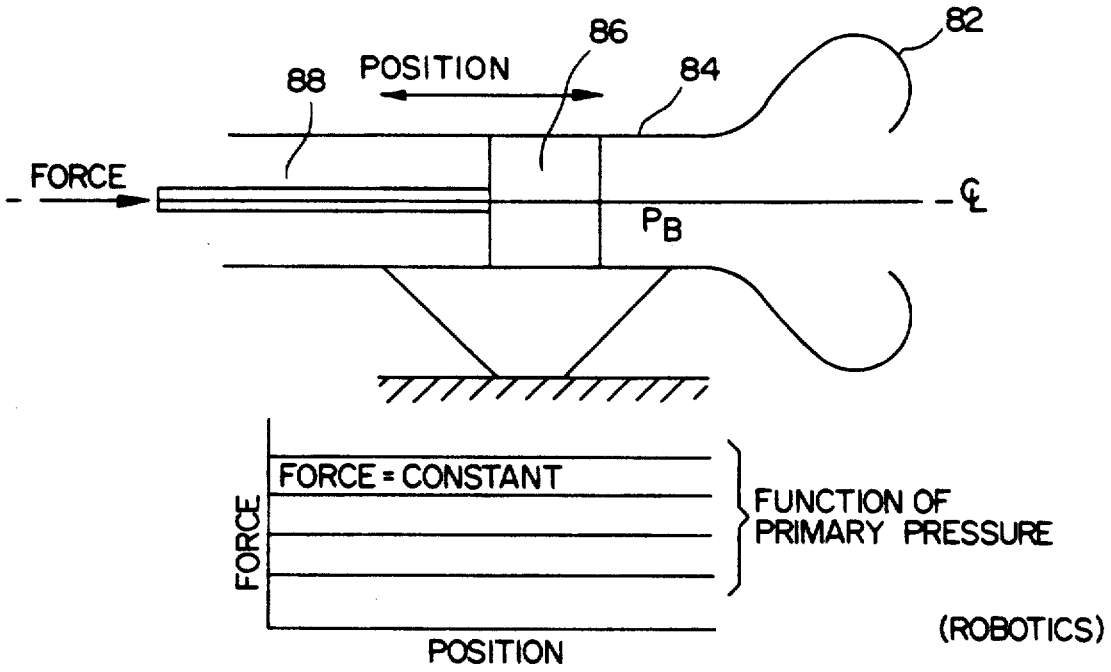
FIG. 11 is a schematic illustration of an embodiment as it applies to the field of robotics.

For a robotic apparatus which provides a constant force, regardless of position or angle, refer to FIG. 11. A recirculating ejector 82, a cylinder 84, a piston 86 and a rod 88 are illustrated. This embodiment creates and sustains a pressure Pb confined by the recirculating jet curtain, the walls of the cylinder 84 and the head of the piston 86. The pressure Pb remains constant, since it is a function of the primary driving fluid pressure, therefore, the pressure force on the piston and the reactive force against the rod is also constant. This will be true regardless of the position of the piston (and rod) or angular orientation of the apparatus.

Figure 12:
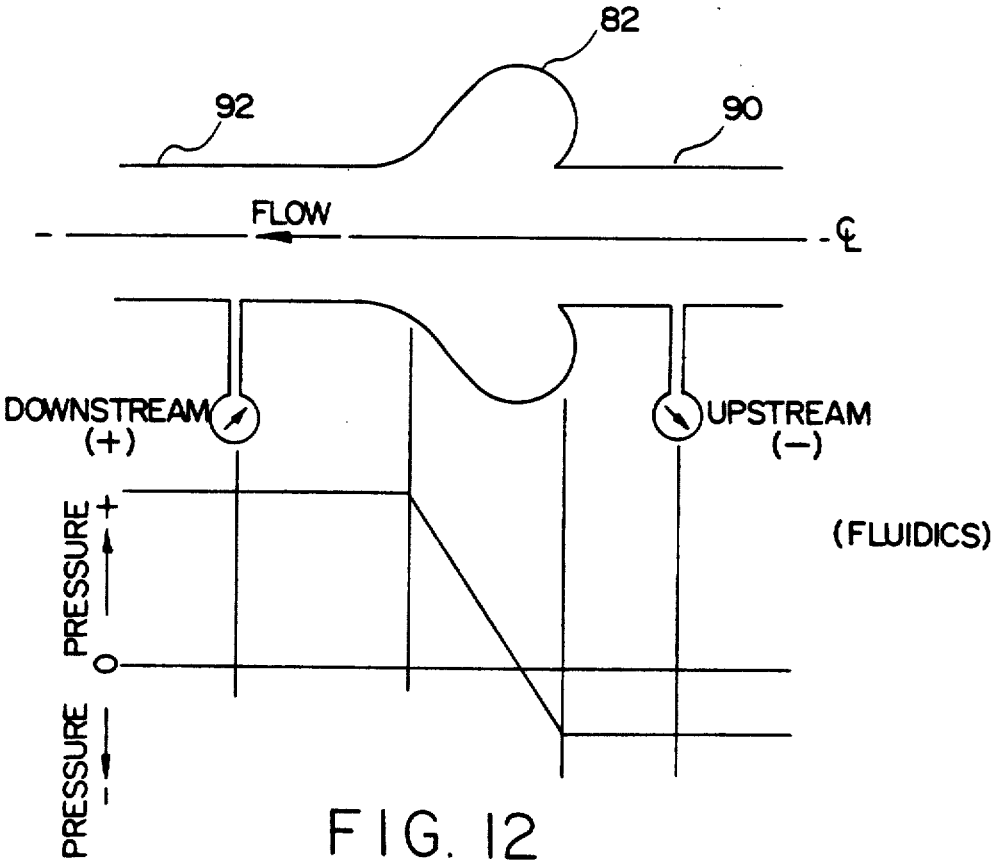
FIG. 12 is a schematic illustration of an embodiment of the invention as it applies to the field of fluidics.

For a fluidic apparatus which provides free flow, or amplified flow in one direction but greatly restricts the flow in the opposite direction, refer to FIG. 12. A recirculating ejector 82, an inlet tube 90 and an exhaust tube 92 are illustrated. When the apparatus is operating, a positive pressure in created and sustained downstream and a negative gage pressure is created and sustained upstream. Pressure gages are shown schematically at upstream and downstream positions and show a positive pressure gradient in a downstream direction.

Having thus described a preferred embodiment of the invention, it will be understood that this invention may be in other forms than that described as being the preferred embodiment and without departing from the scope of the invention as defined by the appended claims. Additionally, while the best mode for carrying out this invention has been described in detail, those familiar with the art to which this invention relates will recognize various alternative designs and embodiments for carrying out this invention as defined by the following claims.

That which is claimed is:

1. A pumping apparatus comprising:

a conduit having an entrance (24) for a pumped fluid and an exit (26) for said pumped fluid;

said conduit being formed by an outer shell (32) and an inner shell (34) connected to said outer shell, said inner shell (34) defining said entrance (24);

two annular surfaces symmetrical about a center line of said conduit, said annular surfaces being linearly displaced in relationship to said center line, one of said annular surfaces (28) nearer said entrance forming an exhaust for a primary fluid, and the other said annular surface (30) being an intake for said primary fluid;

a throat (36) attached to said outer shell (32) forming a portion of said conduit and defining on one end thereof said exit (26) and on the other end thereof said other annular surface (30);

said end of said throat defining said other annular surface (30) being spaced from said inner shell (34) to define a primary exhaust orifice (37) of thickness "t";

said outer shell (32) defining between said inner shell and said throat a plenum (38) for said primary fluid so that said primary fluid can be forced through said primary exhaust orifice (37);

said throat curving radially outwardly opposite the direction of pumped fluid flow;

said inner shell (34) having an interior surface having a radially outward curvature followed by a radially inward curvature followed by a curvature in the axial direction of pumped fluid and forming said one annular surface (28) at its termination whereby exhausting of said primary fluid at said one annular surface and intaking of said primary fluid at said other annular surface cause said pumped fluid to move from said entrance toward said exit.

2. The apparatus according to claim 1 further including a supply tube in communication with said plenum.

3. A process for pumping a fluid media comprising steps of:

providing;

a conduit having an entrance (24) for a pumped fluid and an exit (26) for said pumped fluid; said conduit being formed by an outer shell (32) and an inner shell (34) connected to said outer shell, said inner shell (34) defining said entrance (24);

two annular surfaces symmetrically about a center line of said conduit, said annular surfaces being linearly displaced in relationship to said center line, one of said annular surfaces (28) nearer said entrance forming an exhaust for a primary fluid, and the other said annular surface (30) being an intake for said primary fluid;

a throat (36) attached to said outer shell (32) forming a portion of said conduit and defining on one end thereof said exit (26) and on the other end thereof said other annular surface (30);

said end of said throat defining said other annular surface (30) being spaced from said inner shell (34) to define a primary exhaust orifice (37) of thickness "t";

said outer shell (32) defining between said inner shell and said throat a plenum (38) for said primary fluid so that said primary fluid can be forced through said primary exhaust orifice (37);

said throat curving radially outwardly opposite the direction of pumped fluid flow;

said inner shell (34) having an interior surface having a radially outward curvature followed by a radially inward curvature followed by a curvature in the axial direction of pumped fluid and forming said one annular surface (28) at its termination;

forcing a primary fluid medium from said primary exhaust orifice (37), said primary fluid medium passing over said one annular surface (28) to affect a change of momentum of said primary fluid thereby causing the drawing in of a said pumped fluid into said entrance and forcing said pumped fluid toward said exit.

* * * * *